US005480336A

United States Patent [19]

Blanchard

[11] Patent Number: 5,480,336

[45] Date of Patent: Jan. 2, 1996

[54] WATER TOY CONSTRUCTION KIT

[76] Inventor: Cheri A. Blanchard, 13625 Timberridge Ave., Baton Rouge, La. 70817

[21] Appl. No.: 355,698

[22] Filed: Dec. 14, 1994

[51] Int. Cl.[6] ..... A63H 33/04; A63H 33/30

[52] U.S. Cl. ..... 446/89; 446/475; 434/126; 239/279

[58] Field of Search ..... 446/89, 85, 86, 446/166, 267, 475, 487, 491; 434/126; 482/35; 239/279, 280, 285

[56] References Cited

U.S. PATENT DOCUMENTS

| | | | |
|---|---|---|---|
| 1,373,324 | 3/1921 | Gomez . | |
| 2,580,629 | 1/1952 | Wenzel | 239/280 X |
| 2,747,935 | 5/1956 | Szantay . | |
| 2,750,232 | 6/1956 | Szantay et al. | 239/279 X |
| 3,069,805 | 12/1962 | Burrows . | |
| 3,195,563 | 7/1965 | Race, Jr. . | |
| 3,205,611 | 9/1965 | Onanian . | |
| 3,752,472 | 8/1973 | Snead . | |
| 4,080,752 | 3/1978 | Burge . | |
| 4,498,627 | 2/1985 | Arginsky | 239/279 |
| 4,824,019 | 4/1989 | Lew | 239/279 X |
| 5,156,339 | 10/1992 | Gibson et al. . | |
| 5,180,323 | 1/1993 | Justice . | |
| 5,385,472 | 1/1995 | Mullin | 446/89 X |

FOREIGN PATENT DOCUMENTS

| | | | |
|---|---|---|---|
| 2048088 | 12/1980 | United Kingdom | 446/89 |

OTHER PUBLICATIONS

Popular Mechanics, "From Hoola Hoop to Sprinkler", Jul. 1960, p. 143.

*Primary Examiner*—Robert A. Hafer
*Assistant Examiner*—D. Neal Muir
*Attorney, Agent, or Firm*—Richard C. Litman

[57] ABSTRACT

A water toy construction kit includes a plurality of elongate tubular elements and mating connectors, which elements and connectors provide for the flow of water therethrough. The kit may include rigid and/or flexible elements, and the elements may be opaque, translucent, and/or transparent. At least some of the elements may include radial passages therethrough, either in line or randomly spaced, to provide for the spray of water therethrough. Transparent or translucent tubes may include solid articles therein, which provide movement due to water flow through the tubes. The connectors may include shutoff valves therein to provide for the selective control of water flow through the individual tubes connected thereto. At least one separate element may be provided, which is actuated by free water flow from the remaining structure. An adapter is provided to connect the structure to a standard garden hose connector; the adapter may include a weight to preclude movement of the hose and/or structure due to water flow therethrough. The present kit provides an entertaining way for children to enjoy the refreshing effects of water on a warm day, and provides further enjoyment through the challenge of constructing a structure from the present kit elements.

17 Claims, 2 Drawing Sheets

WATER TOY CONSTRUCTION KIT

FIELD OF THE INVENTION

The present invention relates generally to assembly kits comprising a variety of elongate tubular members and connectors therefor, and more specifically to a kit of such tubular elements which is adapted specifically for the flow of water therethrough and therefrom when an assembly is made from a plurality of the kit elements.

BACKGROUND OF THE INVENTION

The affinity which small children (and even older children and adults) have for water on warm, summer days is well known. One commonly sees children playing with garden hoses and lawn sprinklers on warm, sunny days in the summer, both as a means to cool off and also as a means of entertainment. Children have long been fascinated with the patterns made by a flowing stream of water from a moving water hose, sprinkler or other source.

Another pastime which is perennially popular with children, is that of constructing various articles from construction kits (blocks, etc.) of various sorts. The assembly of some form of structure, even a relatively simple framework, is known to provide children and others with a sense of accomplishment and satisfaction with working with their hands and minds.

However, the above activities heretofore have generally been considered to be mutually exclusive, with construction toys generally not being readily adaptable to use outdoors or with water, and with water play generally not involving any particular need for or mental or manual construction skills.

Accordingly, the need arises for a water toy construction kit which combines elements of both forms of leisure activities for children. The kit must provide a plurality of various lengths of tubing or ductwork adapted for the passage of water therethrough, and must provide further for variation in the water flow and/or other action caused by water flow therethrough, e.g., lateral passages through the side walls of the tubes for sprinkling, clear or translucent tubes with solid elements therein which are moved by water flow, valves for controlling flow through individual elements, etc. The kit must also provide for ease of assembly by small children, without requiring a great deal of manual skill on the part of the assembler. The materials used must also be relatively light in weight, in order to permit ease of handling by small children.

DESCRIPTION OF THE PRIOR ART

U.S. Pat. No. 1,373,324 issued to Blas Gomez on Mar. 29, 1921 discloses a Sprinkling Device comprising a pipe base with a generally vertical pipe extending upwardly therefrom. The upper end of the vertical pipe includes a horizontally positioned nozzle, which may be repositioned about the vertical pipe axis to direct flow in a predetermined direction. No radial passages through the side walls of the pipes are disclosed, nor are any of the various other features of the present invention.

U.S. Pat. No. 2,747,935 issued to Elmer Szantay on May 29, 1956 discloses an End Closure For Flexible Collapsible Tube comprising a clip which is crimped over the end of the tube (i.e., a "soaker" type hose, with a plurality of lateral passages therethrough) to seal the end. The "soaker" hose disclosed is not adaptable to use with the present kit, due to the single end connector and free standing crimped end, as well as other features, and no variations are disclosed to add variety to a structure formed thereby. The flexible, flaccid nature of a soaker hose could not be used universally for all of the components of the present water toy construction kit, due to the lack of structural support provided.

U.S. Pat. No. 3,069,805 issued to William M. Burrows on Dec. 25, 1962 discloses an Amusement Device comprising a plurality of cubes having straight or curved tubular elements installable therethrough. The tubes and connectors are adapted for the passage of a ball (marble, etc.) therethrough, and at least the supporting blocks are not intended to be waterproof; col. 3, lines 41–42 notes that the blocks may be formed of "strong cardboard," among other materials. No disclosure is made of waterproof connectors between the tubes. The tubes apparently must be supported by the blocks or cubes, and are not free standing as in the present water construction toy kit.

U.S. Pat. No. 3,195,563 issued to Austin T. Race, Jr. on Jul. 20, 1965 discloses a Pipe System With Movable Lateral Lines, which system is adapted for use in irrigation. The pipes are all rigid and include various features beyond the scope of the present water toy construction kit, such as automatic shutoff valves, means for remote handling of pipe sections, etc. Moreover, Race does not disclose any provision for free standing, substantially vertical structures formed using his pipe system, as provided for by the present construction kit.

U.S. Pat. No. 3,205,611 issued to Richard A. Onanian on Sep. 14, 1965 discloses Hollow Blocks And Tubular Connecting Means Therefor. One embodiment discloses the closure of the unused passages through the blocks to allow the flow of water therethrough. However, each of the unused passages in each of the blocks assembled to form a continuous line, must be closed off in order to allow flow through the line of blocks. Such a requirement would be akin to using a porous device as a pipe or liquid conduit, and requiring that each leak be stopped before it may be used. While the present invention provides sprinkler and other passages therefrom, the provision of a plurality of passages in every relatively short segment would allow so much water to flow therefrom, that no substantial water conveying structure could be built.

U.S. Pat. No. 3,752,472 issued to Timothy A. Snead on Aug. 14, 1973 discloses a Child's Building Toy comprising a plurality of bent pipe sections including spray passages in a linear array through the lateral walls thereof and mating male and female connectors permanently installed on opposite ends of each section. The ends of the sections must be assembled in a specific relationship to one another, due to the specific gender of each connector on each end, unlike the present invention, with its separate connectors. The spray or sprinkling provided by the Snead linear arrays of passages fails to provide the variety of fluid flow of the present invention, as will be described further below. In addition, the Snead connectors must be quite sturdy structurally, as Snead intends for an assembled structure to support the simultaneous weight and activity of perhaps several children. Thus, the connectors are relatively stout and difficult for a small child to manipulate, unlike the slip joints of the present construction kit. The present kit is not intended to support persons climbing thereon, due to the relatively light materials used and further due to the relatively simple joints.

U.S. Pat. No. 4,080,752 issued to David A. Burge on Mar. 28, 1978 discloses Toy Blocks With Conduits And Fluid Seal Means. The assembly is intended to provide training in the study of fluidics, providing a means of constructing passages and including elements which perform various fluidic functions. No lateral passages are disclosed to provide fluid spray, as provided by the present invention, and the blocks are more equivalent to the connectors of the present invention rather than to the conduits.

U.S. Pat. No. 5,156,339 issued to Kurt A. Gibson et al. on Oct. 20, 1992 discloses a Water Sprinkling Lounge Chair Apparatus having a hose connection to a hollow, tubular peripheral frame. The frame includes a plurality of ports through the walls thereof, allowing for water spray therethrough. Directional nozzles may be installed in the ports, if desired. The device is permanently assembled, thus no tube or pipe connections are disclosed other than the single hose connection, and provides no other water flow functions than lateral spray from the peripheral frame.

Finally, U.S. Pat. No. 5,180,323 issued to Kyle A. Justice on Jan. 19, 1993 discloses Interlocking Toy Components comprising a plurality of solid, rod-like elements having variously configured cooperating male and female end connectors. The end connectors are integrally formed with the rod elements, unlike the present construction kit, and as the rods are solid, no fluid may pass therethrough, as provided by the present water toy kit.

None of the above noted patents, taken either singly or in combination, are seen to disclose the specific arrangement of concepts disclosed by the present invention.

SUMMARY OF THE INVENTION

By the present invention, an improved water toy construction kit is disclosed.

Accordingly, one of the objects of the present invention is to provide an improved water toy construction kit which includes a plurality of tubular elements providing for water flow therethrough and therefrom, and a plurality cooperating connectors serving to connect the tubular elements together as desired.

Another of the objects of the present invention is to provide an improved water toy construction kit which tubular elements are configured to provide a variety of different effects on water flowing therethrough and therefrom, such as discharge streams, movement of apparatus due to hydrodynamic motion, linear and nonlinear spray patterns, movement of solid articles within a transparent or translucent tube due to water flow, etc.

Yet another of the objects of the present invention is to provide an improved water toy construction kit which tubular elements have at least opposite end portions each of the same diameter, with each of the connectors having identical connecting diameters adapted to fit interchangeably with any of the end portions of the tubular elements.

Still another of the objects of the present invention is to provide an improved water toy construction kit which connectors may include more than two connecting means for joining more than two tubular elements together, if desired.

A further object of the present invention is to provide an improved water toy construction kit which may include shutoff valves in at least some of the connectors.

An additional object of the present invention is to provide an improved water toy construction kit which may include means for introducing bubble solution, dyes, or other foreign matter into water flowing though a structure formed by the present kit.

Another object of the present invention is to provide an improved water toy construction kit which may include a separate water activated device operating by means of open flow from a primary structure formed by the present kit.

Yet another object of the present invention is to provide an improved water toy construction kit which includes an adapter mating to a standard garden hose connector, which adapter includes a weight thereon to preclude movement of the adapter, hose, and any attached structure due to fluid flow therethrough.

Still another object of the present invention is to provide an improved water toy construction kit which may include either rigid or flexible tubular members.

A final object of the present invention is to provide an improved water toy construction kit for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENT

Figure 1:
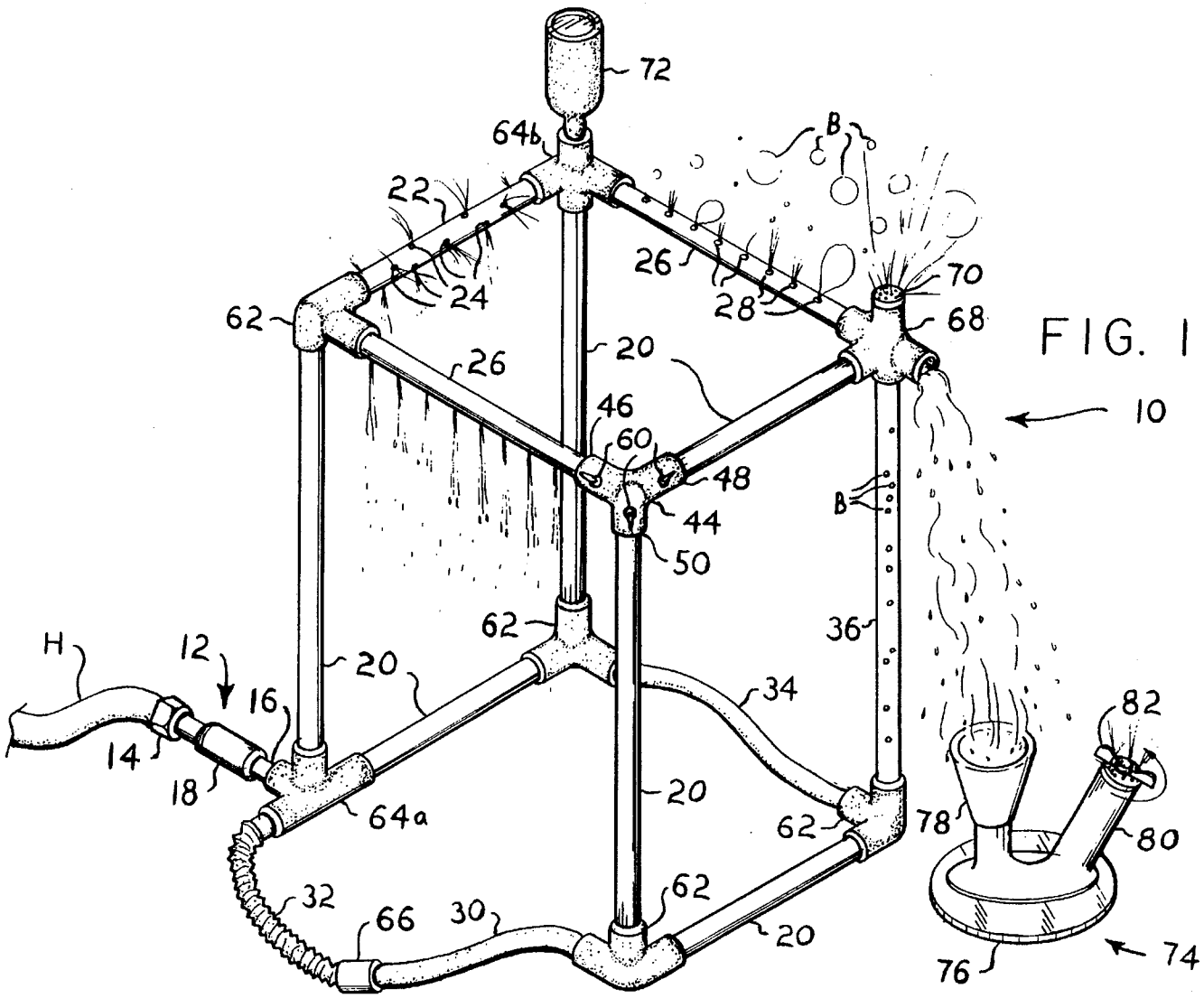
FIG. 1 is a perspective view of an exemplary structure which may be formed using components of the present kit, showing the various features of those components.

Referring now to the drawings, the present invention will be seen to relate to a water toy construction kit, with an exemplary structure 10 comprising an assembly of the various components thereof shown in FIG. 1. (It is emphasized that the structure 10 shown in FIG. 1 is by way of example only, and that any number of different structural designs or configurations may be assembled using the present kit.) The present kit (and any structure constructed therefrom) basically comprises a plurality of elongate Tubular elements of various configurations, and a plurality of hollow connectors of various configurations, with the tubular elements and connectors described in detail further below. The hollow interiors of the tubular elements and the connectors each communicate with one another, to allow the passage of water therethrough and therefrom.

A generally tubular adapter 12 provides for the attachment of a conventional, standard garden hose H to a structure 10 constructed using the present kit. The adapter 12 has a first or inlet end 14 which is configured to connect to the (normally externally threaded) outlet end of a conventional garden hose H, and an opposite second or outlet end 16 which is configured to mate with any one of the connectors of the present kit. The intermediate portion of the adapter 12 may include a weight 18 thereon, which provides mass means for the end of the hose H and any relatively lightweight structure to which it may be connected by means of the adapter 12, to preclude or at least restrict inadvertent movement or "whipping" due to dynamic flow of water therethrough.

The present kit may contain one or more straight and rigid sections of opaque tubing 20, as a basic structural member(s) of the kit. However, numerous variations on the basic tubular concept may be included in the present kit, such as a tube 22 having a plurality of relatively small radially disposed passages 24 through the tube side wall, with the passages 24 randomly placed to provide a wide spread spray of water when the structure 10 has water flowing therethrough. Alternatively, a tube or tubes 26, having similar radial passages 28, may be provided, but with the passages 28 formed in a linear array to provide a "curtain" of water spray.

Other types of tubing may be used with the present kit, as desired. For example, one or more sections of flexible tubing may be included, either formed of a relatively flexible and resilient material to provide a smooth tube 30, or having a convoluted wall to provide flexibility, as in the case of the convoluted flexible tube 32. Alternatively, the rigid tubing discussed above may be provided as a preformed rigid curved tube 32, if desired.

Figure 2A:
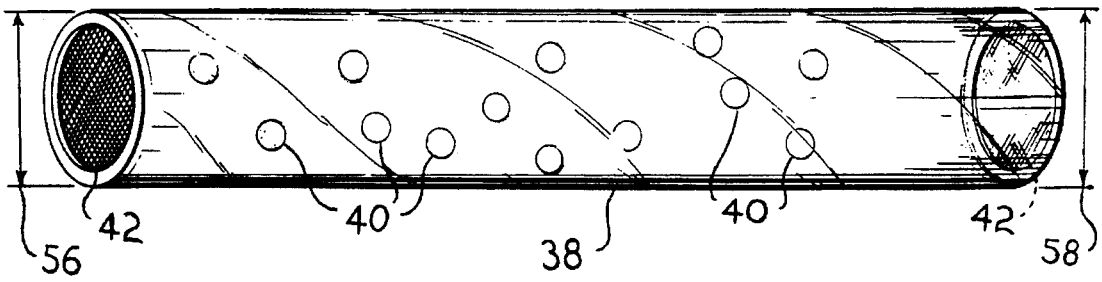
FIG. 2A is a perspective view of one type of tubular member of the present kit, showing its transparent or translucent nature and the plurality of articles captured therein, which are affected by water flow through the tube.

While any of the above discussed tubing components may be formed of opaque material, it will be seen that transparent material may be used to form a transparent tube 36, if desired, in order to allow bubbles B or other visible objects to be seen therein. FIG. 2A provides a detailed perspective view of another transparent tube 38, which has been modified to capture a plurality of solid elements 40 loosely therein. A screen 42 (or other retaining means) is secured at each end of the tube 38, to hold the elements 40 therein. Elements 40 may have a density less than, equal to, or greater than water, as desired. In the case of elements 40 with a greater density than water, the structure constructed using the present kit may be arranged to allow the water flow to move upward through the tube 38, to lift the elements 40 and provide motion thereto. Where such elements 40 will float, the water flow may be adjusted to move downwardly through the tube 38, to force the elements 40 downward. Means of adjusting the water flow are discussed further below.

Figure 2B:
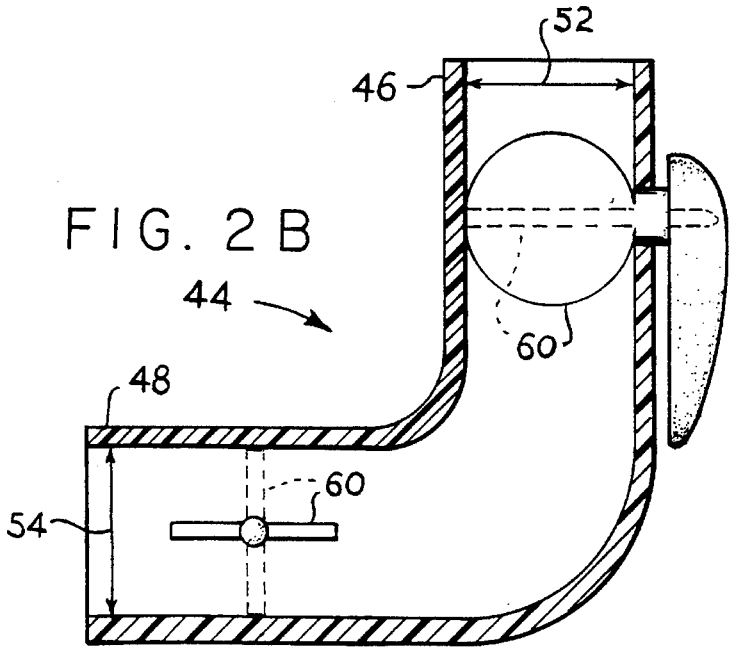
FIG. 2B is a bottom plan view in section of one type of connector of the present kit, showing fluid control valve means therein.

The various tubular elements discussed above are connected together by means of a plurality of mating connectors, such as the connector 44 shown at one corner of the structure 10 of FIG. 1, and in FIG. 2B. (It will be understood that the bottom plan section view of FIG. 2B removes one of the connecting ends from the view.) Connector 44 includes three mutually perpendicular connecting ends 46, 48, and 50, which ends are sized and configured to mate closely with the ends of the various tubes of the present invention discussed above. It will be noted that the internal openings 52 and 54 respectively of the two connecting ends 46 and 48 of the connector 44 (FIG. 2B) are of equal diameter, and that the external ends 56 and 58 of the tube 38 of FIG. 2A are of equal diameter and are sized to mate closely within the internal openings 52 and 54 of the connector 44. The present kit provides for all male or external ends of all tubes to be of the same diameter, and for all female or internal ends or openings of all connectors to be of the same diameter, thus allowing any type of tube to be assembled with any type of connector. A fairly close fitting friction fit is provided between tubes and connectors, which fit will hold the components together without requiring tools for assembly and disassembly, and further provides substantially leak proof connections. (Some seepage may occur, depending upon the tightness of assembly of any given joint or joints and the relative wear of mating components, which is permissible given the intended use of the present invention.)

In many instances, it may be desirable to reduce or completely shut off flow through a section of a structure 10 constructed of the components of the present kit. Accordingly, the various connectors provided may be equipped with one or more externally actuated, manual shutoff valves 60, as shown in the connector 44 of FIG. 4 and in detail in FIG. 2B. The valves 60 are opened or closed by means of their external handles; the valves 60 of FIG. 2B are shown in an open position in solid lines, and in their alternate closed position in broken lines. Again, any of the different types of connectors shown in FIG. 1 and discussed below, may be equipped with such shutoff valves 60, as desired.

Connectors provided with the present kit or structure may have any number of various configurations, such as the three way connector of FIGS. 1 and 2B discussed above, and/or similar three way connectors 62 (without valves) shown at other corner connections in FIG. 1. Other types of connectors may include "Tee" shaped connectors with additional extensions therefrom, as in connectors 64*a* and 64*b* of FIG. 1, and linear connectors 66 having two opposite ends and serving to join two tubular members together end to end. Specialized connectors, such as the five way connector 68 of FIG. 1, including a sprinkler or shower head or nozzle 70, may also be provided. Additional connectors (not shown), e.g., "Y" shaped connectors, six way connectors, etc., with and without shutoff valves in one or more of the connecting ends, and/or having specialized fittings (shower heads, restricting nozzles, etc.) may also be included in the present kit for incorporation into a structure.

The provision of various connectors having additional openings or inlet/outlet ends, provides for the attachment of additional ancillary equipment to a structure 10 constructed using the present kit. For example, a bottle 72 containing foreign matter other than water (e.g., bubble solution, water soluble dye or coloring, etc.) may be connected to the structure via means for attachment, such as a spare connector end on such a connector 64*b*, as shown in FIG. 1. By adjusting the flow properly, bubbles B may be produced by means of the radial passages 28 disposed in a tube downstream of a dispensing bottle 72 containing a bubble solution, as shown in FIG. 1.

By providing a suitable outflow of water from some relatively higher point in the structure 10, a physically separate component 74 may be activated using the force of the outflow. Such a device 74 is shown in FIG. 1, wherein a base 76 provides a mounting for a generally vertically disposed funnel 78, serving as an intake for water outflow from another point on the structure 10. The funnel 78 communicates with an additional water apparatus, such as the tube 80 with a rotating vane 82, actuated by water flow therethrough. Other water activated or water conducting devices, tubes, connectors, etc., may be further connected to such a separate component 74 for further water action and enjoyment thereof by persons using the present invention.

Accordingly, the present invention will be seen to provide innumerable hours of enjoyment for children on warm summer days and in other situations and environments where water activities may be desirable. The present kit, with its numerous tubes and connectors of various configurations, may be assembled in practically limitless configurations to provide further enjoyment by means of the assembly process. Specialized fittings and devices, such as the separate component 74 and ancillary bottle 72, add further to the various effects which may be achieved using the present kit and a structure constructed therefrom. Use of relatively light weight materials, such as polyvinyl chloride or other plastics, results in a kit which allows structures to be built therefrom by smaller children who might not otherwise have the strength or physical dexterity to manipulate relatively heavier metal pipe and/or relatively complex connectors. The present kit, and structures assembled therefrom, may be easily disassembled at the end of a period of use and stored conveniently due to the component configuration of the kit, providing for repetitive assembly, use, and disassembly as desired.

It is to be understood that the present invention is not limited to the sole embodiment described above, but encompasses any and all embodiments within the scope of the following claims.

I claim:

1. A water toy construction kit, comprising:

a plurality of differently configured tubular elements and a plurality of connectors therefor, at least one of said tubular elements being transparent, with said tubular elements and said connectors being adapted to dispense water therethrough and therefrom and to provide a variety of different effects due to water flowing therethrough and therefrom, each of said tubular elements including opposite first and second ends having identical outside diameters, and each of said connectors having at least two connecting ends having identical inside diameters, with said outside diameters of said tubular element ends adapted to mate closely with said inside diameters of said connector connecting ends to provide for removable mating frictional attachment of said tubular elements with said connectors and further to produce substantially leak resistant connecting joints when said tubular element ends are removably inserted into said connector connection ends to form a structure;

at least one connector with mounting means for the attachment of a container for the introduction of foreign matter into an assembled structure formed of said tubular elements and said connectors, with said foreign matter being water soluble dyes of any of a variety of colors; and at least one adapter having a threaded end providing for the removable connection of a conventional garden hose having an outlet end to a corresponding one of said connectors of said kit, said adapter having an inlet end compatibly and removably connectible to the conventional garden hose outlet end, an opposite outlet end compatibly and rigidly removably connectible to said at least one of said connectors of said kit, and further including mass means to restrict inadvertent movement of said garden hose outlet end, said adapter, and said at least one of said connectors rigidly connected thereto and any structure connectibly extending therefrom, due to water flow therethrough, whereby the water toy construction kit is used to assemble a structure comprising a plurality of said tubular members removably connected to a plurality of said connectors and is removably connected to the conventional garden hose by means of said adapter, and the garden hose is used to supply water flow to and through the structure with the structure thereby providing a variety of different effects due to water flowing therethrough and therefrom.

2. The water toy construction kit of claim 1, including:

at least one rigid tubular element and at least one flexible tubular element.

3. The water toy construction kit of claim 2, wherein:

said at least one said rigid tubular element is curved.

4. The water toy construction kit of claim 2, wherein:

said at least one flexible tubular element comprises a tube having a convoluted wall adapted to provide flexibility for said flexible tubular element.

5. The water toy construction kit of claim 1, wherein:

at least one of said tubular elements includes a wall having a plurality of passages radially disposed therethrough in a random pattern, with said passages adapted to provide a random spray pattern when water flows through said at least one of said tubular elements.

6. The water toy construction kit of claim 1, wherein:

at least one of said tubular elements includes a wall having a plurality of passages radially disposed therethrough in a linear pattern, with said passages adapted to provide a linear spray pattern when water flows through said at least one of said tubular elements.

7. The water toy construction kit of claim 1, wherein:

said at least one transparent tubular element includes a plurality of solid elements captured therein and adapted to provide movement of said solid elements within said at least one transparent tubular element when water flows therethrough.

8. The water toy construction kit of claim 1, wherein:

at least one of said connectors includes at least one water shutoff valve therein, with said shutoff valve being externally and manually operable to selectively control water flow through said connector.

9. A water toy, comprising:

a plurality of differently configured tubular elements and a plurality of connectors therefor, with said tubular elements and said connectors being adapted to dispense water therethrough and therefrom and to provide a variety of different effects due to water flowing therethrough and therefrom, at least one of said tubular elements being transparent, each of said tubular elements including opposite first and second ends having identical outside diameters, and each of said connectors having at least two connecting ends having identical inside diameters, with said outside diameters of said tubular element ends mated closely with said inside diameters of said connector connecting ends providing removable mating frictional attachment of said tubular elements with said connectors and further producing substantially leak resistant connecting joints as said tubular element ends have been removably inserted into said connector connection ends to form the toy;

at least one connector with mounting means for the attachment of a container for the introduction of foreign matter into an assembled structure formed of said tubular elements and said connectors, with said foreign matter being water soluble dyes of any of a variety of colors; and at least one adapter providing for the removable connection of a conventional garden hose, said adapter having an outlet end engaged to a corresponding connector of said water toy, said adapter having a threaded inlet end compatibly connected to the garden hose, said outlet end compatibly and rigidly connected to said corresponding connector of said water toy, and further including mass means to restrict inadvertent movement of said water toy the water toy being removably connected to the conventional garden hose by means of said adapter, where the garden hose is used to supply water flow to and through the toy with the toy thereby providing a variety of different effects due to water flowing therethrough and therefrom.

10. The water toy of claim 9, including:

at least one rigid tubular element and at least one flexible tubular element.

11. The water toy of claim 10, wherein:

said at least one said rigid tubular element is curved.

12. The water toy of claim 10, wherein:

said at least one flexible tubular element comprises a tube having a convoluted wall adapted to provide flexibility for said flexible tubular element.

13. The water toy of claim 9, wherein:

at least one of said tubular elements includes a wall having a plurality of passages radially disposed therethrough in a random pattern, with said passages adapted to provide a random spray pattern when water flows through said at least one of said tubular elements.

14. The water toy of claim 9, wherein:

at least one of said tubular elements includes a wall having a plurality of passages radially disposed therethrough in a linear pattern, with said passages adapted to provide a linear spray pattern when water flows through said at least one of said tubular elements.

15. The water toy of claim 9, wherein:

said at least one transparent tubular element includes a plurality of solid elements captured therein and adapted to provide movement of said solid elements within said at least one transparent tubular element when water flows therethrough.

16. The water toy of claim 9, wherein:

at least one of said connectors includes at least one water shutoff valve therein, with said shutoff valve being externally and manually operable to selectively control water flow through said connector.

17. A water toy, comprising:

a plurality of differently configured tubular elements and a plurality of connectors therefor, with said tubular elements and said connectors being adapted to dispense water therethrough and therefrom and to provide a variety of different effects due to water flowing therethrough and therefrom;

each of said tubular elements including opposite first and second cylindrical ends having identical outside diameters, each of said connectors having at least two connecting ends having identical inside diameters, with said outside diameters of said tubular element ends mated closely with said inside diameters of said connector connecting ends, providing for removable mating frictional attachment of said tubular elements with said connectors and further producing substantially leak proof connecting joints with said tubular element ends removably inserted into said connector connection ends to form the toy;

at least one threaded adapter providing for the removable connection of a conventional garden hose, said adapter having an outlet end attached to a corresponding connector of the water toy, said adapter having an inlet end compatibly connected to a conventional garden hose, said outlet end compatibly and rigidly connected to said corresponding connector of said water toy, said adapter further including mass means to restrict inadvertent movement of said garden hose, said adapter, and the structure extending therefrom, whereby the water toy is removably connected to the conventional garden hose by means of said adapter, where the garden hose is used to supply water flow to and through the toy with the toy thereby providing a variety of different effects due to water flowing therethrough and therefrom;

a nozzle in at least one of said connectors; and a water intake component positioned separately from, adjacent to, and below said nozzle, said water intake component having a funnel dimensioned and configured to receive water from said nozzle and deliver the water to a water apparatus in which a rotating vane rotates under pressure of the water.

* * * * *